US011952752B2

(12) United States Patent
Johnson

(10) Patent No.: US 11,952,752 B2
(45) Date of Patent: Apr. 9, 2024

(54) EJECTION PADDLE

(71) Applicant: Caterpillar Paving Products Inc., Brooklyn Park, MN (US)

(72) Inventor: Nicholas B. Johnson, Dayton, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 385 days.

(21) Appl. No.: 17/302,331

(22) Filed: Apr. 30, 2021

(65) Prior Publication Data

US 2022/0349156 A1 Nov. 3, 2022

(51) Int. Cl.
*E02F 9/28* (2006.01)
*E02F 3/24* (2006.01)

(52) U.S. Cl.
CPC ..... *E02F 9/2866* (2013.01); *E02F 3/245* (2013.01)

(58) Field of Classification Search
CPC ..... E01C 23/088; E01C 23/127; E02F 3/245; E02F 3/241; E02F 9/2866
See application file for complete search history.

(56) References Cited

U.S. PATENT DOCUMENTS

| | | | | | |
|---|---|---|---|---|---|
| 4,871,213 | A * | 10/1989 | Hanson | E02F 7/00 | 37/190 |
| 6,131,838 | A * | 10/2000 | Balvanz | B02C 13/2804 | 241/300 |
| 6,213,560 | B1 * | 4/2001 | Lindblom | B28D 1/186 | 404/90 |
| 7,055,770 | B2 * | 6/2006 | Bardos | B02C 18/14 | 241/300 |
| D624,941 | S * | 10/2010 | Buhr | D15/28 | |
| D628,602 | S * | 12/2010 | Buhr | D15/28 | |
| 8,003,234 | B2 * | 8/2011 | Omori | B23B 27/141 | 427/419.7 |
| 8,469,456 | B2 * | 6/2013 | Buhr | E01C 23/088 | 299/39.2 |
| 8,496,402 | B2 | 7/2013 | McPhail et al. | | |
| D719,988 | S | 12/2014 | Runquist et al. | | |
| 9,038,933 | B2 * | 5/2015 | Fredsall | B02C 18/184 | 241/300 |
| 9,353,491 | B2 | 5/2016 | Wachsmann | | |
| 10,407,850 | B2 | 9/2019 | Buhr et al. | | |
| 11,298,758 | B2 * | 4/2022 | Wang | B23C 5/202 | |

* cited by examiner

*Primary Examiner* — Jessica H Lutz
(74) *Attorney, Agent, or Firm* — Harrity & Harrity, LLP

(57) ABSTRACT

In some implementations, an ejection paddle may include a paddle body having an ejection surface and a mounting surface opposite the ejection surface, and a wear region projecting from the ejection surface and extending along a top edge of the paddle body and at least a portion of a first side edge and a second side edge of the paddle body. The paddle body may be recessed relative to the wear region.

20 Claims, 6 Drawing Sheets

600

EJECTION PADDLE

TECHNICAL FIELD

The present disclosure relates generally to milling machines and, for example, to an ejection paddle for a milling machine.

BACKGROUND

Milling machines are typically utilized to remove one or more layers of old or defective road surface in preparation for resurfacing. Machines, such as cold planers, rotary mixers, and other milling machines, are used for scarifying, removing, mixing, or reclaiming material from ground surfaces. Such machines include a rotor assembly enclosed within a rotor chamber. The rotor assembly includes a cylindrical rotor drum and a plurality of cutting elements mounted on the rotor drum. In some examples, the rotor assembly may include one or more ejection paddles mounted on the rotor drum. When the machine is performing a milling operation, the cutting elements impact the ground surface and create debris. The ejection paddles provide conveyance and ejection of the debris from the rotor chamber. Thus, the ejection paddles are impacted by the debris during the milling operation and wear over time. As a result, a useful life of the ejection paddles may be relatively short.

U.S. Pat. No. 10,407,850 (the '850 patent) discloses an ejector unit having an ejector that is replaceably mounted on a carrier. The '850 patent discloses that the ejector is curved in a scoop-like fashion, and that the ejector is reversible upon the carrier to allow the ejector to be reversed after one wear surface is worn. The '850 patent also indicates that one or more depressions can be introduced into a conveying surface of the ejector, such that material removed during tool use can become deposited in the depressions. However, the ejector of the '850 patent does not provide wear resistance along the sides of the ejector where wear due to material impact is typically high. Moreover, due to the reversibility of the ejector of the '850 patent, the ejector has a complex design and utilizes excessive material.

The ejection paddle of the present disclosure solves one or more of the problems set forth above and/or other problems in the art.

SUMMARY

In some implementations, an ejection paddle includes a paddle body having an ejection surface and a mounting surface opposite the ejection surface; and a wear region projecting from the ejection surface and extending along a top edge of the paddle body and at least a portion of a first side edge and a second side edge of the paddle body, the paddle body being recessed relative to the wear region.

In some implementations, a rotor assembly includes a rotor drum, a plurality of cutting elements disposed on an outer surface of the rotor drum, and at least one ejector paddle disposed on the outer surface of the rotor drum, the at least one ejector paddle including: a paddle body having an ejection surface and a mounting surface opposite the ejection surface; and a wear region projecting from the ejection surface and extending along a top edge of the paddle body and at least a portion of a first side edge and a second side edge of the paddle body, the wear region and the paddle body defining a recessed region of the at least one ejector paddle.

In some implementations, a machine includes a rotor drum and at least one ejector paddle disposed on an outer surface of the rotor drum, the at least one ejector paddle comprising: a paddle body having an ejection surface and a mounting surface opposite the ejection surface; and a wear region projecting from the ejection surface and extending along a top edge of the paddle body and at least a portion of a first side edge and a second side edge of the paddle body, the ejection surface of the paddle body being recessed relative to the wear region.

DETAILED DESCRIPTION

This disclosure relates to an ejection paddle, which is applicable to any machine that performs milling, or other cutting, of a ground surface. For example, the machine may be a milling machine, such as a cold planer, a rotary mixer, or the like.

Figure 1:
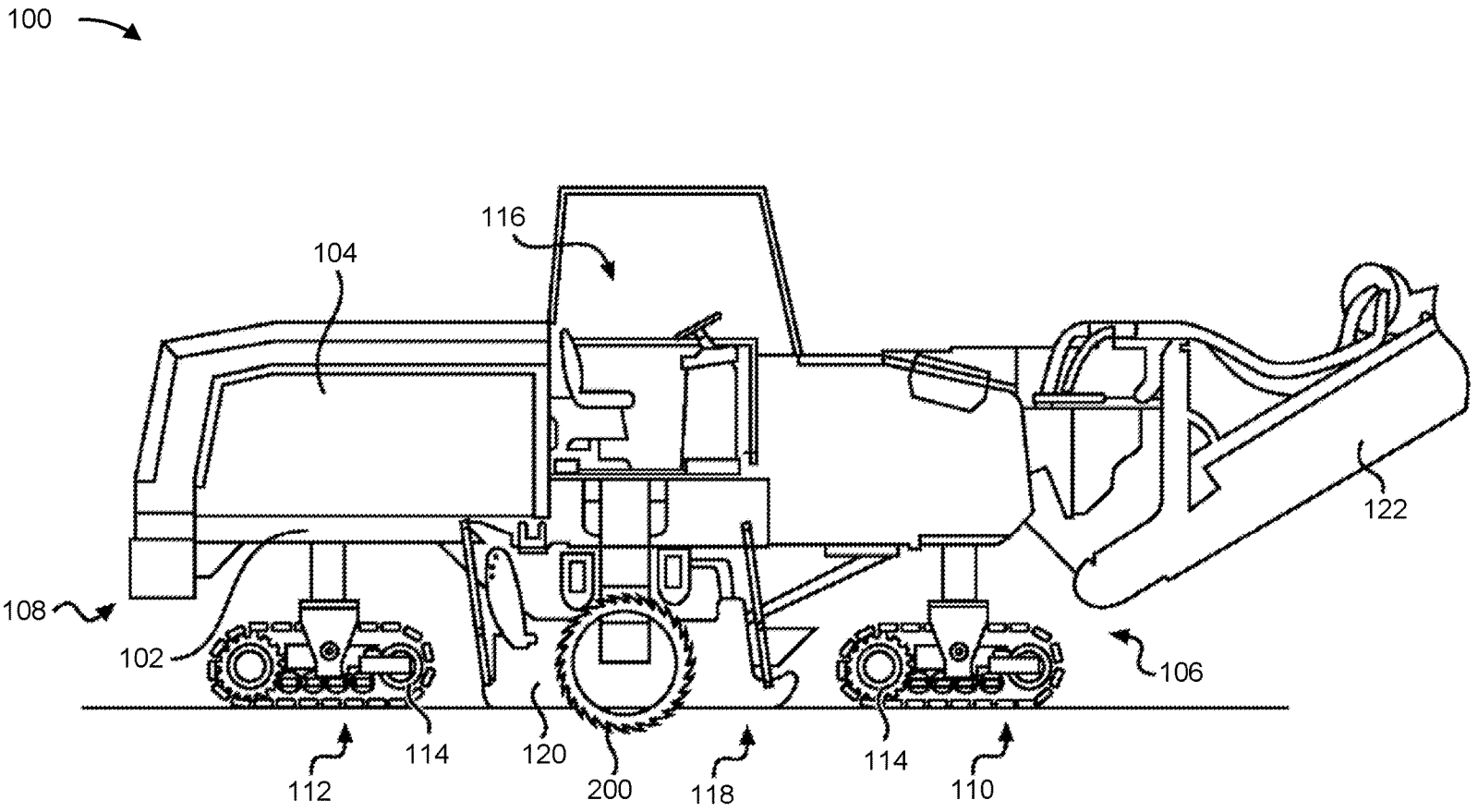
FIG. 1 shows a side view of an example machine.

FIG. 1 shows a side view of an example machine 100. The machine 100 may be a milling machine, which is shown in FIG. 1 as a cold planer. However, the present disclosure is not limited to a cold planer, and the machine 100 may be another machine that removes materials from a ground surface or a roadbed, such as a rotary mixer, a reclaimer, or any other milling-type machine.

The machine 100 includes a frame 102. An engine enclosure 104 is attached to the frame 102 and may house an engine (not shown). The engine may be an internal combustion engine and may provide propulsion power to the machine 100, and also provide power for various components of the machine 100. The machine 100 has a front end 106 and a rear end 108. The front end 106 of the machine 100 includes a front drive assembly 110, and the rear end 108 of the machine 100 includes a rear drive assembly 112. Each of the front drive assembly 110 and the rear drive assembly 112 may include one or more tracks 114. The tracks 114 may be driven by a hydraulic system of the machine 100. The front drive assembly 110 and/or the rear drive assembly 112 may include one or more wheels (not shown) in addition or alternatively to the tracks 114. The machine 100 includes an operator platform 116, where an operator of the machine 100 may sit or stand to operate the machine 100 using one or more controls. In some examples, the machine 100 may be an autonomous machine and exclude the operator platform 116.

The machine 100 includes a rotor chamber 118 that partially encloses a rotor assembly 200, as described below in connection with FIG. 2. The rotor chamber 118 may be positioned between the front drive assembly 110 and the rear drive assembly 112. The rotor chamber 118 is defined by a first side plate 120 and a second side plate (not shown) disposed on respective sides of the machine 100. The rotor assembly 200 is rotatably coupled to the frame 102 and is positioned within the rotor chamber 118. That is, the rotor assembly 200 is positioned between the first side plate 120 and the second side plate. In some examples, the machine 100 may include a moldboard (not shown) positioned to the rear of the rotor assembly 200, for example, to direct material toward the rotor assembly 200 and/or to form a smooth milled surface. In some examples, the rotor assembly 200 may be a height-adjustable rotor assembly.

The machine 100 includes a conveyor 122 coupled to the frame 102. The conveyor 122 may be positioned at the front end 106 of the machine 100. The conveyor 122 may include one or more conveyors that each include a plurality of rollers (not shown) and a conveyor belt (not shown) that rotates around the plurality of rollers. The conveyor 122 may receive milled material (e.g., debris) from the rotor assembly 200, convey the milled material away from the rotor chamber 118, and discharge the milled material into a haul vehicle (not shown), or the like.

As indicated above, FIG. 1 is provided as an example. Other examples may differ from what is described with regard to FIG. 1.

Figure 2:
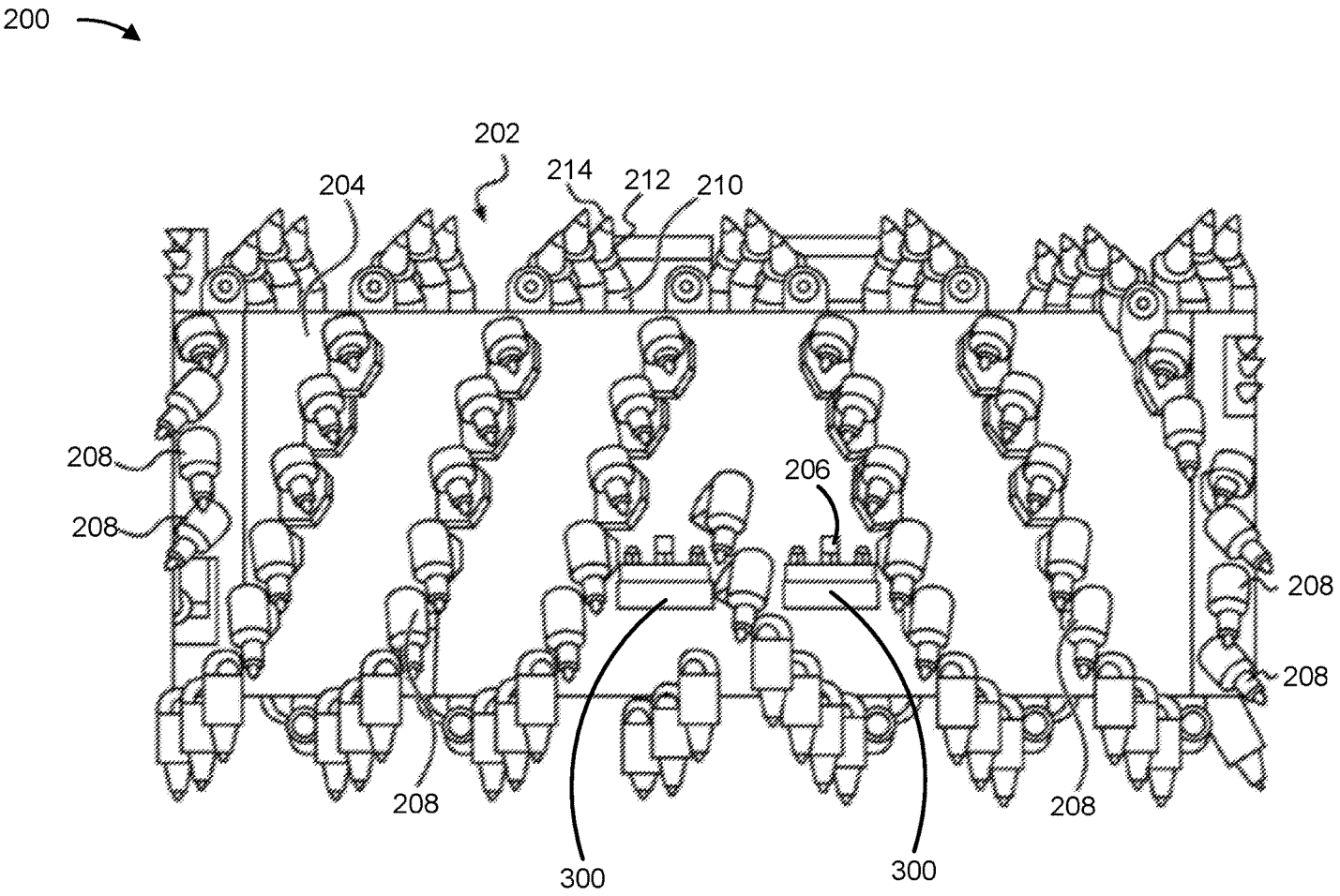
FIG. 2 shows a rear view of an example rotor assembly.

FIG. 2 shows a rear view of an example rotor assembly 200. As shown in FIG. 2, the rotor assembly 200 includes a generally cylindrical rotor drum (or shell) 202. The rotor assembly 200 includes one or more ejection paddles 300, as described below in connection with FIGS. 3-6, disposed on an outer surface 204 of the rotor drum 202. A paddle support 206 may be coupled (e.g., by welds) to the outer surface 204 of the rotor drum 202, and an ejection paddle 300 may be mounted to the paddle support 206 (e.g., by one or more bolts, or the like).

The rotor assembly 200 includes a plurality of cutting elements 208 disposed on the outer surface 204 of the rotor drum 202. The cutting elements 208 may be arranged helically on the outer surface 204 of the rotor drum 202. For example, a first portion of the cutting elements 208 may be arranged helically in a first direction starting from a first end of the rotor drum 202, and a second portion of the cutting elements 208 may be arranged helically in a second direction starting from a second end of the rotor drum 202. This arrangement of the cutting elements 208 promotes movement of milled material toward a central portion of the rotor drum 202 where the ejection paddle(s) 300 may convey the milled material to the conveyor 122 (shown in FIG. 1).

A cutting element 208 may include a tool block 210, a tool holder 212, and a cutting bit 214. The tool block 210 is coupled (e.g., by welds) to the outer surface 204 of the rotor drum 202. The tool holder 212 is received (e.g., via an interference fit coupling) within an opening of the tool block 166. The cutting bit 214 is coupled (e.g., brazed) to the tool holder 212. The cutting bit 214 may be configured to cut into a ground surface. For example, the cutting bit 214 may be composed of a hard material such as a carbide-based material or a diamond-based material. Thus, the rotor assembly 200 may be lowered to a ground surface such that the rotor assembly 200 engages and cuts the ground surface through force applied to the ground surface by the cutting elements 208.

As indicated above, FIG. 2 is provided as an example. Other examples may differ from what is described with regard to FIG. 2.

Figure 3:
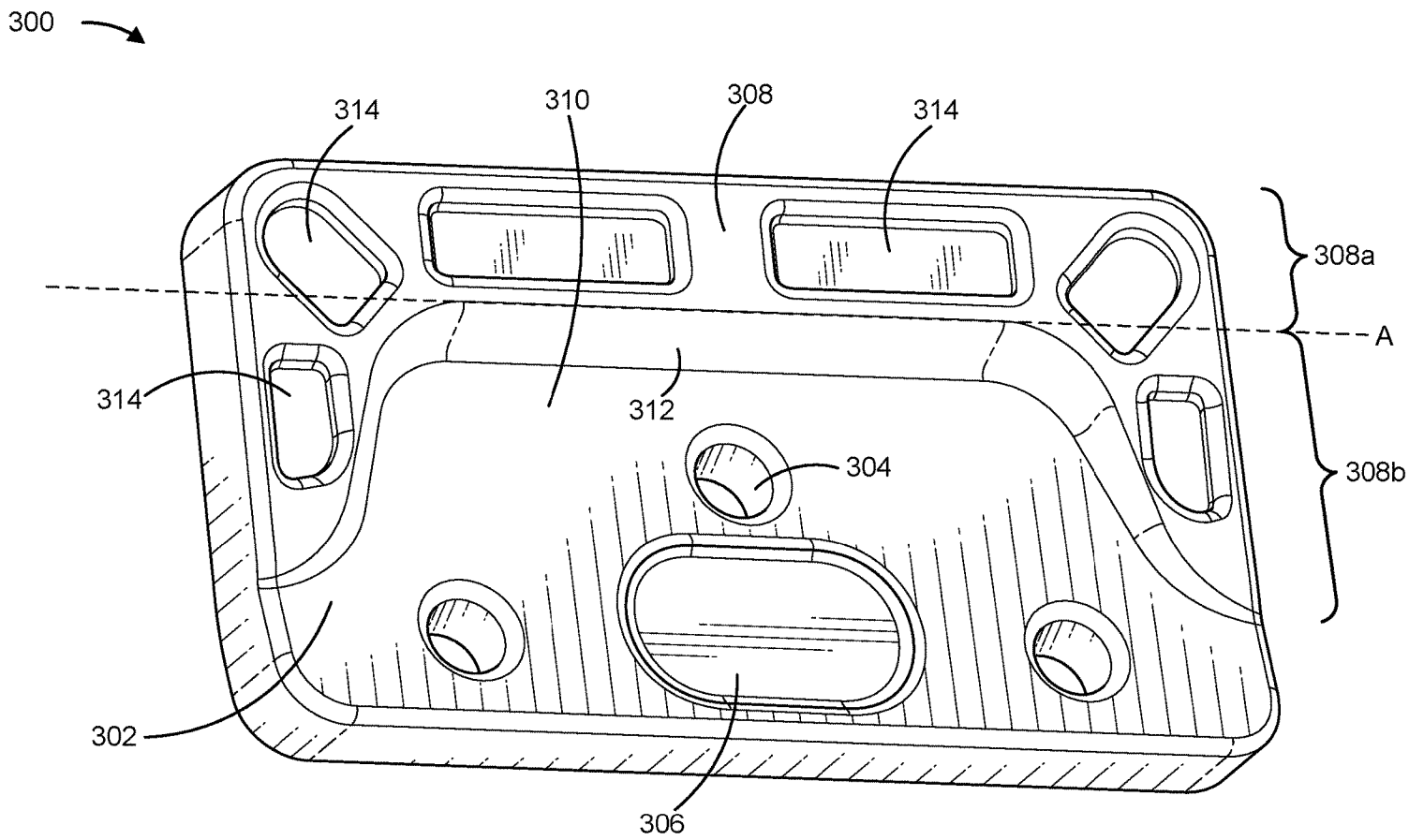
FIG. 3 shows a perspective view of an example ejection paddle.

FIG. 3 shows a perspective view of an example ejection paddle 300. As shown in FIG. 3, the ejection paddle 300 may be in the form of a generally rectangular (e.g., having a greater width than height) plate. However, other forms of the ejection paddle 300 are possible. The ejection paddle 300 may be composed of a metallic material, such as steel. The ejection paddle 300 may be a forged piece (e.g., a single forged piece), thereby simplifying manufacture of the ejection paddle 300.

As shown in FIG. 3, the ejection paddle 300 includes a paddle body 302. The paddle body 302 has an ejection surface (shown in FIG. 3) and a mounting surface opposite the ejection surface. The ejection surface of the paddle body 302 faces a direction of rotation of the rotor assembly 200 (shown in FIG. 2) during a milling operation. Thus, the ejection surface of the paddle body 302 is configured to impact milled material (e.g., debris) during the milling operation. The mounting surface of the paddle body 302 faces opposite the direction of rotation of the rotor assembly 200 during the milling operation. For example, the mounting surface of the paddle body 302 faces and abuts the paddle support 206 of the rotor assembly 200 (shown in FIG. 2). Thus, the mounting surface of the paddle body 302 is configured to interface with the paddle support 206.

The paddle body 302 may include one or more (e.g., a plurality of) apertures 304. For example, the paddle body 302 may include three apertures 304. Here, a first aperture 304 may be located above a recessed region 306, and second and third apertures 304 may be located to respective sides of the recessed region 306. In other words, the three apertures 304 may be arranged triangularly in the paddle body 302, with an aperture 304 at an apex of the triangle being located at a center line of the ejection paddle 300. An aperture 304 extends from the ejection surface to the mounting surface of the paddle body 302. An aperture 304 is configured to receive a fastener (e.g., a bolt, or the like) for securing the ejection paddle 300 to the paddle support 206 of the rotor assembly 200. For example, the fastener may be received in a corresponding aperture of the paddle support 206 and secured by a bolt, the fastener may be secured in a corresponding threaded cavity of the paddle support 206, or the like. The paddle body 302 may include one or more (e.g., a plurality of) recessed regions 306. A recessed region 306 includes a region of the paddle body 302 that is recessed relative to the ejection surface of the paddle body 302. The recessed region 306 is configured to retain milled material (e.g., debris) to promote material-on-material impact to the paddle body 302 rather than direct impact of milled material to the paddle body 302.

As shown in FIG. 3, the ejection paddle 300 includes a wear region 308. As described above, the paddle body 302 and the wear region 308 may be a unitary piece (e.g., a unitary forged piece). The wear region 308 may be a continuous (e.g., non-segmented) region that provides wear resistance to areas of the ejection paddle 300 that receive the most wear during milling operations.

The wear region 308 projects (e.g., in the direction of the rotation of the rotor assembly 200) from the ejection surface of the paddle body 302. The wear region 308 extends along a top edge of the paddle body 302 and at least a portion of a first side edge and a second side edge of the paddle body 302. The first side edge and the second side edge are opposite edges of the paddle body 302 and are respectively adjacent to the top edge of the paddle body 302. Thus, the wear region 308 is generally U-shaped.

The wear region 308 includes a portion **308*a* that extends along the top edge of the paddle body 302 (which may be referred to herein as a top portion 308*a* of the wear region 308), and portions 308*b* that extend along the side edges of the paddle body 302 (which may be referred to herein as side portions 308*b* of the wear region 308). The delineation between the top portion 308*a* and the side portions 308*b* may be defined by an edge (A) of the wear region 308 parallel to the top edge of the paddle body 302 (as shown in FIG. 3**).

The wear region 308 (e.g., the side portions 308*b*) may extend to a bottom edge (opposite the top edge) of the paddle body 302, or the wear region 308 (e.g., the side portions 308*b*) may terminate short of the bottom edge of the paddle body 302. In some examples, the wear region 308 does not extend along the bottom edge of the paddle body 302. Thus, the ejection paddle 300 is not reversible, but has a simplified design that uses relatively less material.

As described above, the wear region 308 projects from the ejection surface of the paddle body 302, and thus, the paddle body 302 (e.g., the ejection surface of the paddle body) is recessed relative to the wear region 308. In other words, the paddle body 302 and the wear region 308 define a recessed region 310 (e.g., a pocket) of the ejection paddle 300. For example, a step 312 may define a point of transition from the recessed paddle body 302 to the projecting wear region 308. The recessed region 310 is configured to retain milled material (e.g., debris) to promote material-on-material impact to the ejection paddle 300, in a similar manner as described above. For example, the recessed region 310 is configured to retain material resulting from milling of a ground surface.

In some examples, the wear region 308 projects uniformly from (e.g., relative to) the ejection surface of the paddle body 302. In some other examples, the wear region 308 projects non-uniformly from (e.g., relative to) the ejection surface of the paddle body 302. For example, the side portions 308*b* of the wear region 308 (e.g., that extend along the first side edge and the second side edge of the paddle body 302), may be sloped (e.g., angled) relative to the ejection surface of the paddle body 302 (e.g., while the top portion 308*a* of the wear region 308 projects uniformly from the ejection surface of the paddle body 302). As an example, the amount of projection of the wear region 308 from the ejection surface of the paddle body 302 may increase (e.g., from ends of the wear region 308) toward the top edge of the paddle body 302. In other words, the step 312 may increase in thickness toward the top edge of the paddle body 302. The slope of the wear region 308 facilitates ejection (e.g., onto the conveyor 122) of milled material that is conveyed by the ejection paddle 300 (e.g., rather than the milled material being continuously circulated by the ejection paddle 300).

In addition, the wear region 308 may have a non-uniform width. For example, a first side portion 308*b* of the wear region 308 (e.g., that extends along the first side edge of the paddle body 302) may taper toward the first side edge, and a second side portion 308*b* of the wear region 308 (e.g., that extends along the second side edge of the paddle body 302) may taper toward the second side edge (e.g., while the top portion 308*a* of the wear region 308 has a uniform width). The tapering of the wear region 308 provides clearance for fasteners (e.g., bolts) to be received in the apertures 304.

The wear region 308 may include at least one recessed region 314 (e.g., a pocket). The recessed region 314 includes a region of the wear region 308 that is recessed relative to a surface of the wear region 308 (e.g., a surface facing generally in the same direction as the ejection surface of the paddle body 302). The recessed region 314 may be recessed to at least 20%, at least 25%, at least 30%, or at least 35% of a thickness of the wear region 308. The recessed region 314 is configured to retain milled material (e.g., debris) to promote material-on-material impact to the wear region 308, in a similar manner as described above.

As shown in FIG. 3, the wear region 308 includes a plurality of recessed regions 314. For example, the wear region 308 may include six recessed regions 314, although a different quantity of recessed regions 314 is possible (e.g., five recessed regions 314, four recessed regions 314, or the like). The plurality of recessed regions 314 may encompass at least 50%, at least 70%, or at least 90% of a total area of the surface of the wear region 308.

The plurality of recessed regions 314 may include one or more side recessed regions 314 in the side portions 308*b* of the wear region 308. A side recessed region 314 may be elongated in a direction parallel to the side edges of the paddle body 302. A side recessed region 314 may taper toward a corresponding side edge, in a similar manner as described above, to maximize an area of the side recessed region 314. The plurality of recessed regions 314 may include one or more top recessed regions 314 in the top portion 308*a* of the wear region 308. A top recessed region 314 may be elongated in a direction parallel to the top edge of the paddle body 302. A top recessed region 314 may be generally rectangular. The plurality of recessed regions 314 may include one or more corner recessed regions 314 that straddle the top portion 308*a* and the side portion(s) 308*b* of the wear region 308. A corner recessed region 314 may be elongated in a direction that is at an angle relative to the top edge and the side edges of the paddle body 302. A portion of a corner recessed region 314, adjacent a corner of the wear region 308, may be arched to maximize an area of the corner recessed region 314.

One or more of the recessed regions 314 may be filled with a wear-resistant material (not shown). For example, the wear-resistant material may be brazed, or otherwise infused, into a recessed region 314. The wear-resistant material is a material that has a greater wear-resistance (e.g., a greater hardness) than a material of the ejection paddle 300. The wear-resistant material may include a carbide-based material (e.g., iron carbide, titanium carbide, tungsten carbide, or the like).

As indicated above, FIG. 3 is provided as an example. Other examples may differ from what is described with regard to FIG. 3.

Figure 4:
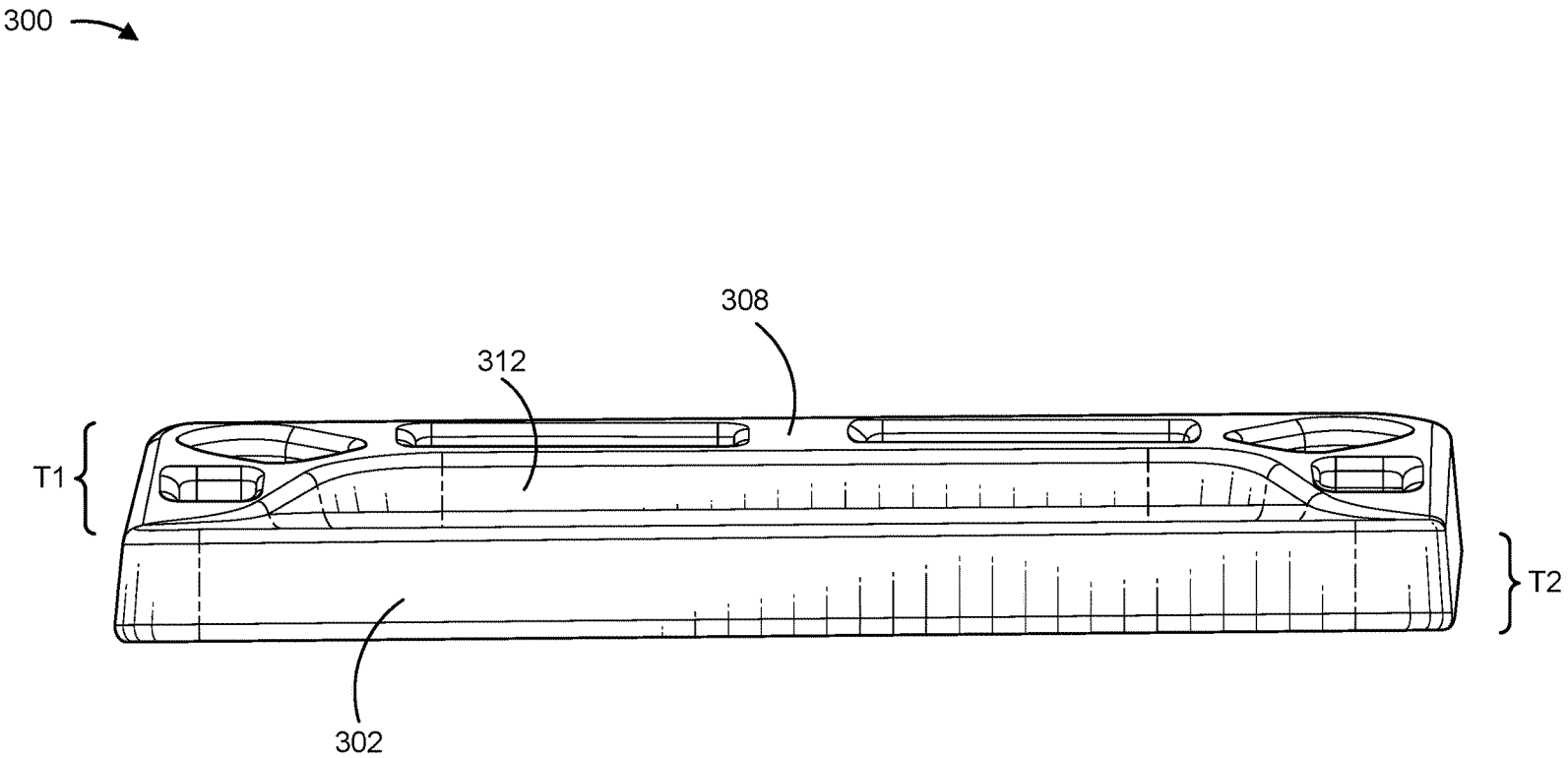
FIG. 4 shows a bottom view of the ejection paddle of FIG. 3.

FIG. 4 shows a bottom view of the ejection paddle of FIG. 3. As shown in FIG. 4 (and also shown in FIG. 5), a thickness T1 (e.g., a maximum thickness) of the wear region 308 is greater than a thickness T2 of the paddle body 302. For example, the thickness T1 of the wear region 308 may be at least 15%, at least 25%, at least 35%, or at least 50% greater than the thickness T2 of the paddle body 302. The thickness T1 of the wear region 308 is not excessive relative to the thickness T2 of the paddle body 302 to conserve material.

As indicated above, FIG. 4 is provided as an example. Other examples may differ from what is described with regard to FIG. 4.

Figure 5:
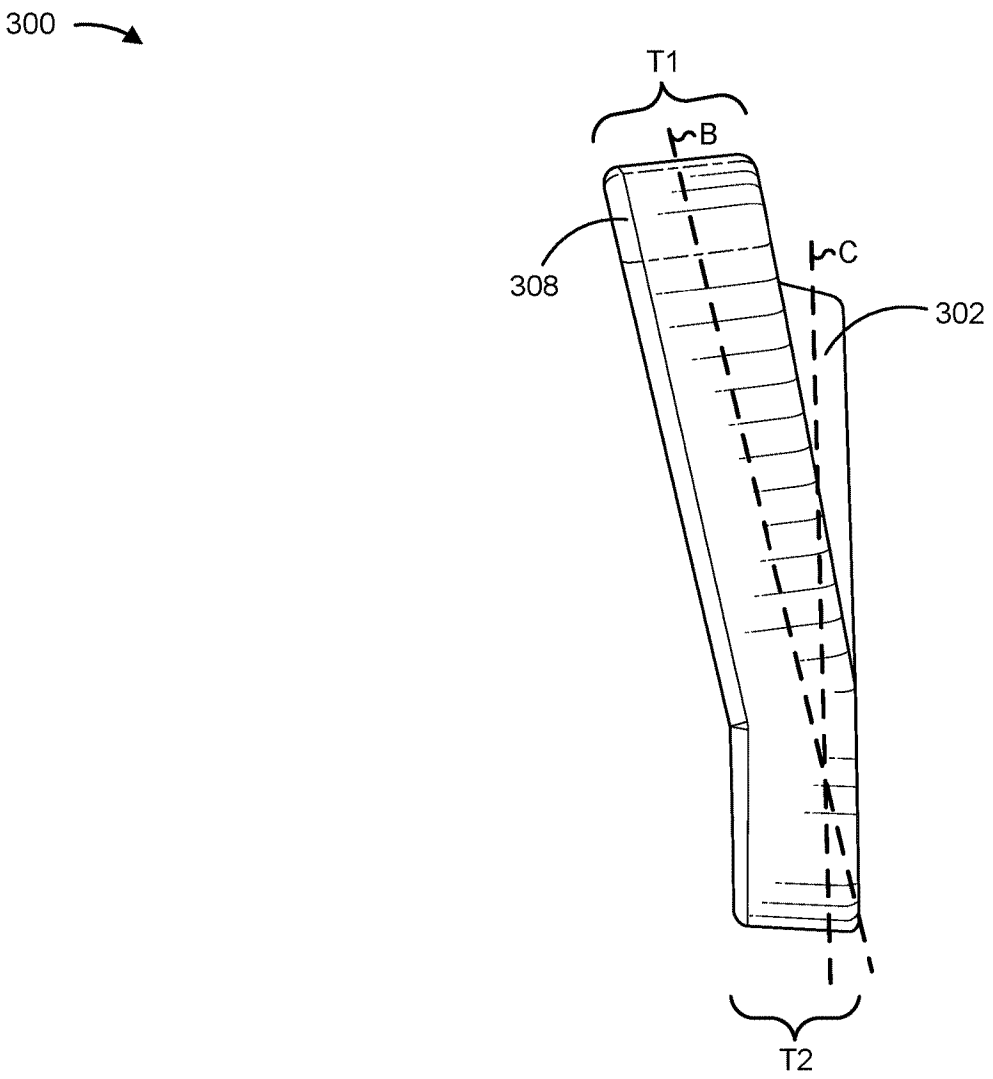
FIG. 5 shows a side view of the ejection paddle of FIG. 3.

FIG. 5 shows a side view of the ejection paddle of FIG. 3. As shown in FIG. 5, a plane (B) defined by the wear region 308 intersects a plane (C) defined by the paddle body 302. In other words, the wear region 308 is angled (e.g., tilted) relative to the paddle body 302. This results in the slope of the wear region 308, described above in connection with FIG. 3. Stated differently, as shown in FIG. 5, the mounting surface of the paddle body 302 may be sloped (e.g., angled) relative to the wear region 308, such that a distance between the mounting surface and the wear region 308 increases toward the top of the mounting surface.

As shown in FIG. 5, a portion of the wear region 308 (e.g., the top portion 308*a* of the wear region 308) may extend beyond the top edge of the paddle body 302. In some examples, the portion of the wear region 308 that extends beyond the top edge may have a thickness greater than T1. For example, this portion of the wear region 308 may have a thickness that extends from the surface of the wear region 308 to the mounting surface of the paddle body 302 (or a point short of or beyond the mounting surface of the paddle body 302). In other words, the portion of the wear region 308 that extends beyond the top edge of the paddle body 302 may be thicker than a remaining portion of the wear region 308. In this way, the portion of the wear region 308 that is most susceptible to wear (e.g., the top portion 308*a*) can have a greater thickness without obstructing structures for mounting of the ejection paddle 300 at the mounting surface of the paddle body 302.

As indicated above, FIG. 5 is provided as an example. Other examples may differ from what is described with regard to FIG. 5.

Figure 6:
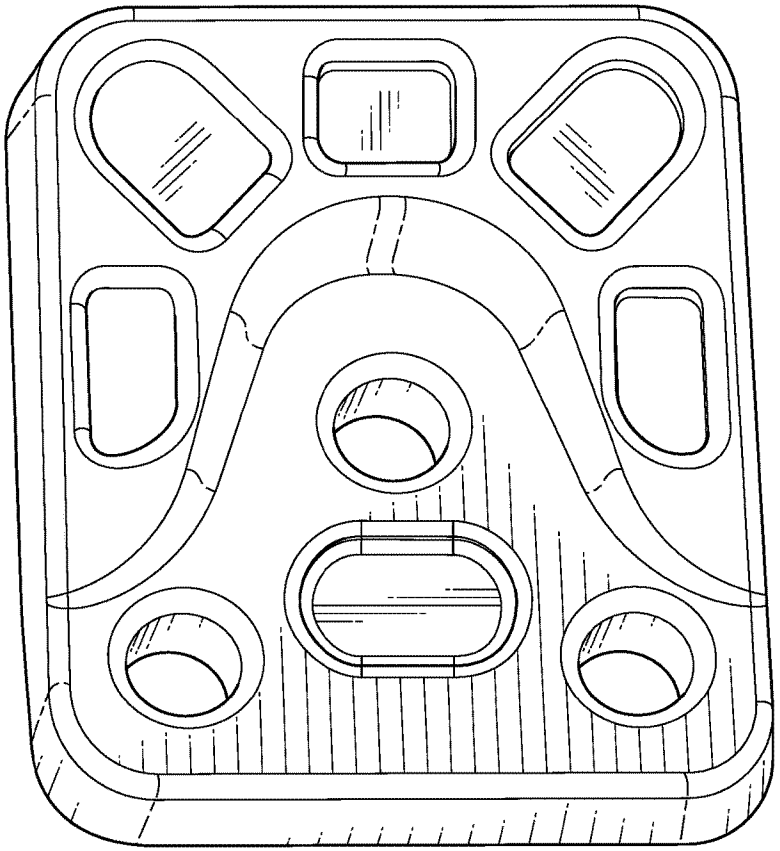
FIG. 6 shows a perspective view of another example ejection paddle.

FIG. 6 shows a perspective view of another example ejection paddle 600. The ejection paddle 600 may have the features of the ejection paddle 300, as described above in connection with FIGS. 3-5. Moreover, the ejection paddle 600 may be disposed on the outer surface 204 of the rotor drum 202 of the rotor assembly 200, in a similar manner as described above in connection with FIG. 2. As shown, the ejection paddle 600 may be in the form of a generally square plate. For example, heights of the ejection paddle 600 and the ejection paddle 300 may be approximately equal, but a width of the ejection paddle 600 may be less than a width of the ejection paddle 300. Thus, the ejection paddle 600 may be suitable for use with a rotor assembly 200 having cutting elements 208 that are relatively close together. Other ejection paddles having a smaller width than the width of the ejection paddle 600, a width in between the width of ejection paddle 300 and the width of ejection paddle 600, and/or a width greater than the width of ejection paddle 300 are also contemplated by the present disclosure. Moreover, a rotor assembly 200 may include multiple ejection paddles of different sizes.

As indicated above, FIG. 6 is provided as an example. Other examples may differ from what is described with regard to FIG. 6.

INDUSTRIAL APPLICABILITY

The ejection paddle described herein may be used in any machine for which ejection of debris from a rotor chamber is desired. For example, the ejection paddle may be used in a machine that includes a rotor assembly for milling or a similar operation. In particular, the ejection paddle may be disposed on an outer surface of a rotor drum, which may be included in a rotor chamber of a milling machine. The ejection paddle provides conveyance and ejection of milled material from the rotor chamber. As described above, due to impact from debris, the ejection paddle is susceptible to wear or other damage.

However, the ejection paddle described herein includes a wear region that extends along the top edge and at least portions of each side edge of a paddle body of the ejection paddle. In this way, the wear region provides improved wear resistance to areas of the ejection paddle that are most susceptible to wear. In addition, the wear region and the paddle body define a recessed region (e.g., a pocket) of the ejection paddle. Moreover, the wear region may include one or more recessed regions. These recessed regions are configured to retain milled material on the ejection paddle such that debris impacting the ejection paddle impacts the milled material rather than directly impacting the ejection paddle. In this way, wear to the ejection paddle is reduced. Furthermore, side portions of the wear region may be sloped relative to the paddle body. This prevents milled material from being trapped on the ejection paddle, so that the milled material can be ejected from the rotor chamber by the ejection paddle rather than being continuously circulated in the rotor chamber. Thus, the ejection paddle described herein has improved wear resistance and a longer useful life, while providing efficient ejection of milled material. In addition, the simplified design of the ejection paddle described herein conserves material and facilitates streamlined manufacture of the ejection paddle, such as by unitary forging of the ejection paddle.

What is claimed is:

1. An ejection paddle, comprising:
- a paddle body having an ejection surface and a mounting surface opposite the ejection surface; and
- a wear region projecting from the ejection surface and including:
  - a top portion extending along a top edge of the paddle body,
  - a first side portion extending from the top portion and along a first side edge of the paddle body, and
  - a second side portion extending from the top portion and along a second side edge of the paddle body.

2. The ejection paddle of claim 1, wherein the paddle body and the wear region define a recessed region of the ejection paddle.

3. The ejection paddle of claim 1, wherein a thickness of the wear region is greater than a thickness of the paddle body.

4. The ejection paddle of claim 1, wherein the wear region comprises at least one recessed region.

5. The ejection paddle of claim 4, wherein the at least one recessed region is filled with a wear-resistant material.

6. The ejection paddle of claim 1, wherein the first side portion of the wear region and the second side portion of the wear region are sloped relative to the ejection surface of the paddle body.

7. The ejection paddle of claim 1, wherein the first side portion of the wear region tapers toward the first side edge of the paddle body, and
- wherein the second side portion of the wear region tapers toward the second side edge of the paddle body.

8. A rotor assembly, comprising:
- a rotor drum;
- a plurality of cutting elements disposed on an outer surface of the rotor drum; and
- at least one ejector paddle disposed on the outer surface of the rotor drum, the at least one ejector paddle comprising:
  - a paddle body having an ejection surface and a mounting surface opposite the ejection surface; and
  - a wear region projecting from the ejection surface and including:
    - a top portion extending along a top edge of the paddle body, and at least
    - a first side portion extending from the top portion and along a first side edge of the paddle body, and
    - a second side portion extending from the top portion and along a second side edge of the paddle body,
  - the wear region and the paddle body defining a recessed region of the at least one ejector paddle.

9. The rotor assembly of claim 8, wherein a thickness of the wear region is greater than a thickness of the paddle body.

10. The rotor assembly of claim 8, wherein the wear region comprises a plurality of recessed regions.

11. The rotor assembly of claim 8, wherein the first side portion of the wear region and the second side portion of the wear region are sloped relative to the ejection surface of the paddle body.

12. The rotor assembly of claim 8, wherein the wear region is angled relative to the paddle body.

13. The rotor assembly of claim 8, wherein the wear region terminates short of a bottom edge of the paddle body opposite the top edge.

14. The rotor assembly of claim 8, wherein the recessed region is configured to retain material resulting from milling of a ground surface.

15. A machine, comprising:

a rotor drum; and at least one ejector paddle disposed on an outer surface of the rotor drum, the at least one ejector paddle comprising:

a paddle body having an ejection surface and a mounting surface opposite the ejection surface; and a wear region projecting from the ejection surface and including:

a top portion extending along a top edge of the paddle body, a first side portion extending from the top portion and along a first side edge of the paddle body, and a second side portion extending from the top portion and along a second side edge of the paddle body.

16. The machine of claim 15, wherein the paddle body and the wear region define a recessed region of the ejection paddle.

17. The machine of claim 15, wherein a thickness of the wear region is greater than a thickness of the paddle body.

18. The machine of claim 15, wherein the wear region comprises at least one recessed region.

19. The machine of claim 15, wherein the first side portion of the wear region and the second side portion of the wear region are sloped relative to the ejection surface of the paddle body.

20. The machine of claim 15, wherein the wear region is a continuous region.

* * * * *